US005420474A

United States Patent [19]

Schmitt, Jr. et al.

[11] Patent Number: 5,420,474

[45] Date of Patent: May 30, 1995

[54] FOCUSABLE LAMP CAPSULE IN A CEMENTLESS BASE

[75] Inventors: Robert J. Schmitt, Jr., Raymond; James P. Szep, Peterborough; William L. Kretovic, Concord, all of N.H.

[73] Assignee: Osram Sylvania Inc., Danvers, Mass.

[21] Appl. No.: 92,650

[22] Filed: Jul. 15, 1993

[51] Int. Cl.[6] ..... H01J 5/48

[52] U.S. Cl. ..... 313/318.1; 313/51; 439/611

[58] Field of Search ..... 313/49, 51, 318; 439/611, 613, 614, 615, 616, 619

[56] References Cited

U.S. PATENT DOCUMENTS

| | | | |
|---|---|---|---|
| 4,013,335 | 3/1977 | Varkonyi et al. | 313/318 |
| 4,295,076 | 10/1981 | Eckhardt | 313/318 |
| 4,567,397 | 1/1986 | Wilhelm | 313/318 |
| 4,849,670 | 7/1989 | Hellwig et al. | 313/318 |
| 5,039,905 | 8/1991 | Essers et al. | 313/318 |
| 5,039,909 | 8/1991 | Kiesling et al. | 439/619 |
| 5,043,624 | 8/1991 | Hirozumi et al. | 313/318 |
| 5,150,008 | 9/1992 | Lee | 313/318 |
| 5,291,092 | 3/1994 | Coushaine | 313/318 |
| 5,308,273 | 5/1994 | Meade et al. | 313/318 |

*Primary Examiner*—Sandra L. O'Shea
*Assistant Examiner*—Vip Patel
*Attorney, Agent, or Firm*—William E. Meyer

[57] ABSTRACT

A focusable lamp having lamp capsule, coupler, and a base is disclosed. The capsule is formed with rigid leads. The capsule and coupler are further formed to allow capsule to be held in the coupler and still focused with respect to the coupler. The coupler also includes an internally projecting tab that is sufficiently near one lead that despite movement of the lead during focusing, the gap between the lead and tab may be bridged by solder to thereby electrically and mechanically fix the lamp capsule to the coupler. The coupler and second lead are further aligned and connected to a base. No cement is needed to position the lamp capsule.

13 Claims, 3 Drawing Sheets

FOCUSABLE LAMP CAPSULE IN A CEMENTLESS BASE

TECHNICAL FIELD

The invention relates to electric lamps, and particularly to singled ended lamps with a base. More particularly the invention is concerned with a press sealed lamp focusably mounted in a base.

BACKGROUND ART

In the past, single ended press sealed lamps have been mounted in bayonet type bases using a saurizing cement. The lamp leads were welded to lead extensions, that in turn were soldered or welded to the rim and center contacts of the bayonet base. To focus the lamp, the capsule was moved to its proper location, thereby bending the lead extensions. The region around the press seal, and the remaining volume of the bayonet base were then filled with a saurizing cement. The design has short comings. The attachment of the lead extensions requires several steps in locating the pieces, and in making the welds or solder joints. The lead extensions cost money, take time to install, and are subject to failure. The capsules may be jarred between the time they are focused and the time they are cemented. There may be wire memory, or incomplete bending of the lead extensions, again resulting in inaccurate preservation of the focused location. There is a need for a press sealed lamp, mounted in a base that does not use lead extensions.

Another problem with cement, is that an excess of cement may mound up around the lower end of the lamp capsule. The excess cement may be removed by chipping, or filing it away. The filed region exposed a softer or looser core of material that can subsequently act as a source of cement particles that interfere with lamp contacts, optics, and other equipment. These shed cement particle have caused customers to demand better lamp designs. There is then a need for a press sealed lamp in a base that is not cemented in place.

An alterative prior art form, the lamp capsule was held in a metal retainer. The retainer required the press seal to include locating indentations. The press seal was then fitted into the retainer so the sprung prongs mated with the indentations. The indentations and prongs then positively located and preserved the lamp position. Finally the retainer was crimped, rim to rim to the top edge of the base. The lamp focus was then designed into the structure. There was no opportunity to empirically set the focus. The only way to control the final lamp focus was to accurately manufacture the filament, the support leads, the capsule body, the press seal, the coupler and so forth. If there was any error in the manufacture, there was no opportunity to dynamically relocate the lamp capsule to its proper position. The lead extensions still had to be positioned and welded to the lamp leads, and then welded or solder to their respective base contacts. There is then a need for a focusable lamp.

Examples of the prior art are shown in the following U.S. patents:

U.S. Pat. No. 4,295,076 issued to Fritz Eckart et al on Oct. 13, 1981 shows a metal based bayonet lamp. The press sealed base is pinched in place by a snap in coupler.

U.S. Pat. No. 4,567,397 issued to Deiter Wilhelm et al on January shows a press sealed lamp capsule held in a metal base bayonet lamp. The press seal is braced and clamped in a coupler so as to be fixed in position by the coupler.

U.S. Pat. No. 4,849,670 issued to Paul Hellig et al on Jul. 18, 1989 shows a press sealed lamp capsule held in a metal bayonet type base. The single piece base is notched and indented to form a clamp structure that couples to features of the press seal. The base is also braced against the envelope to thereby positions the lamp capsule.

U.S. Pat. No. 4,869,689 issued to Reinhard Angerer on Sep. 26, 1989 shows abayonet lamp with a press sealed capsule held in a ceramic base.

DISCLOSURE OF THE INVENTION

A focusable lamp may be formed from a lamp capsule having a press seal with a first lead and a second lead extending from the press seal, and a base having a first wall with a defined opening to receive and position the press seal, while allowing focusing motion of the lamp capsule with respect to the coupler, and having a second wall defining an internal region with an internally projecting tab located sufficiently near the first lead to be to electrically and mechanically coupled to the first lead by rigid, conductive bridge. The base is further formed to have a first contact point, and a second contact point insulated from the first contact point. A rigid conductive bridge couples the projecting tab to the first lead to thereby hold the lamp capsule in a desired position, while a second electrical coupling is made between the second lead and the second contact point.

BEST MODE FOR CARRYING OUT THE INVENTION

Figure 1:
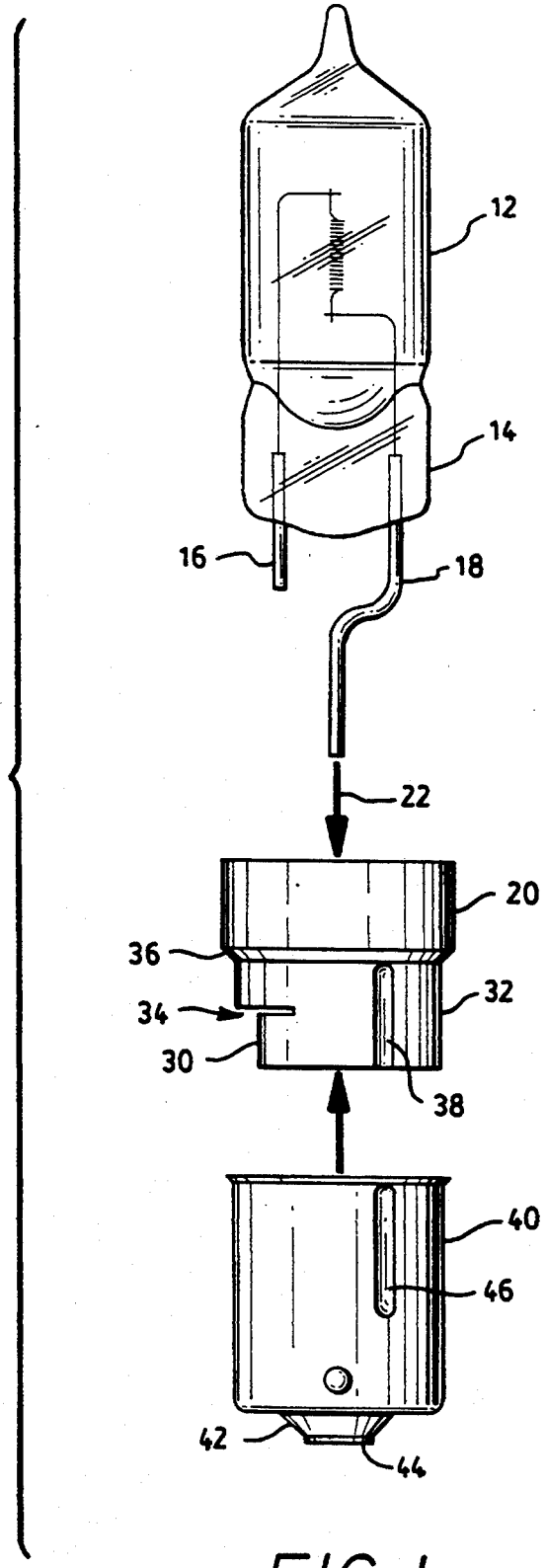
FIG. 1 shows an exploded view of a preferred embodiment of a focusable lamp.

FIG. 1 shows a preferred embodiment of a focusable lamp. Like reference numbers designate like or corresponding parts throughout the drawings and specification. The focusable lamp is assembled from a lamp capsule 12, a coupler 20, and a base 40.

Figure 2:
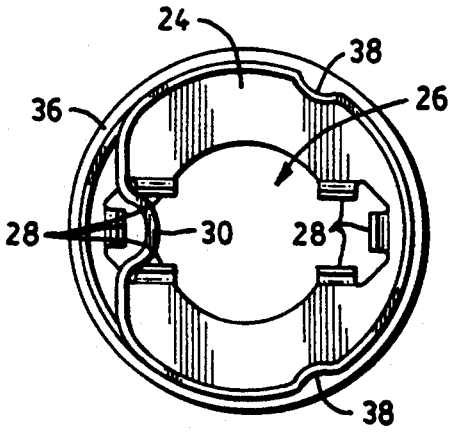
FIG. 2 shows an upward view through the coupler.
Figure 3:
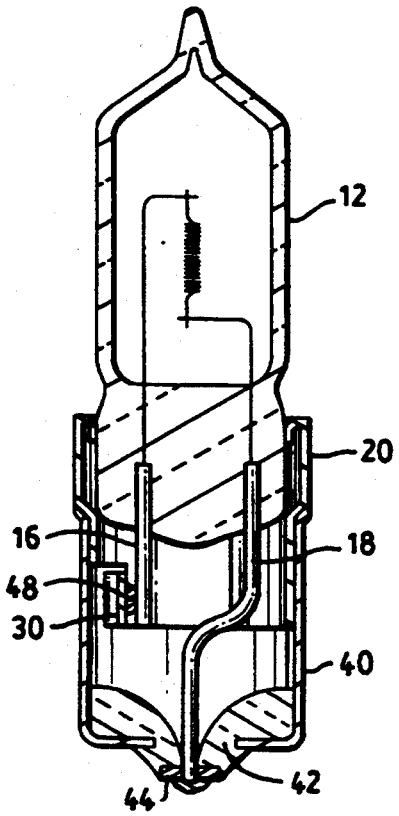
FIG. 3 shows a cross sectional view of an assembled lamp.
Figure 4:
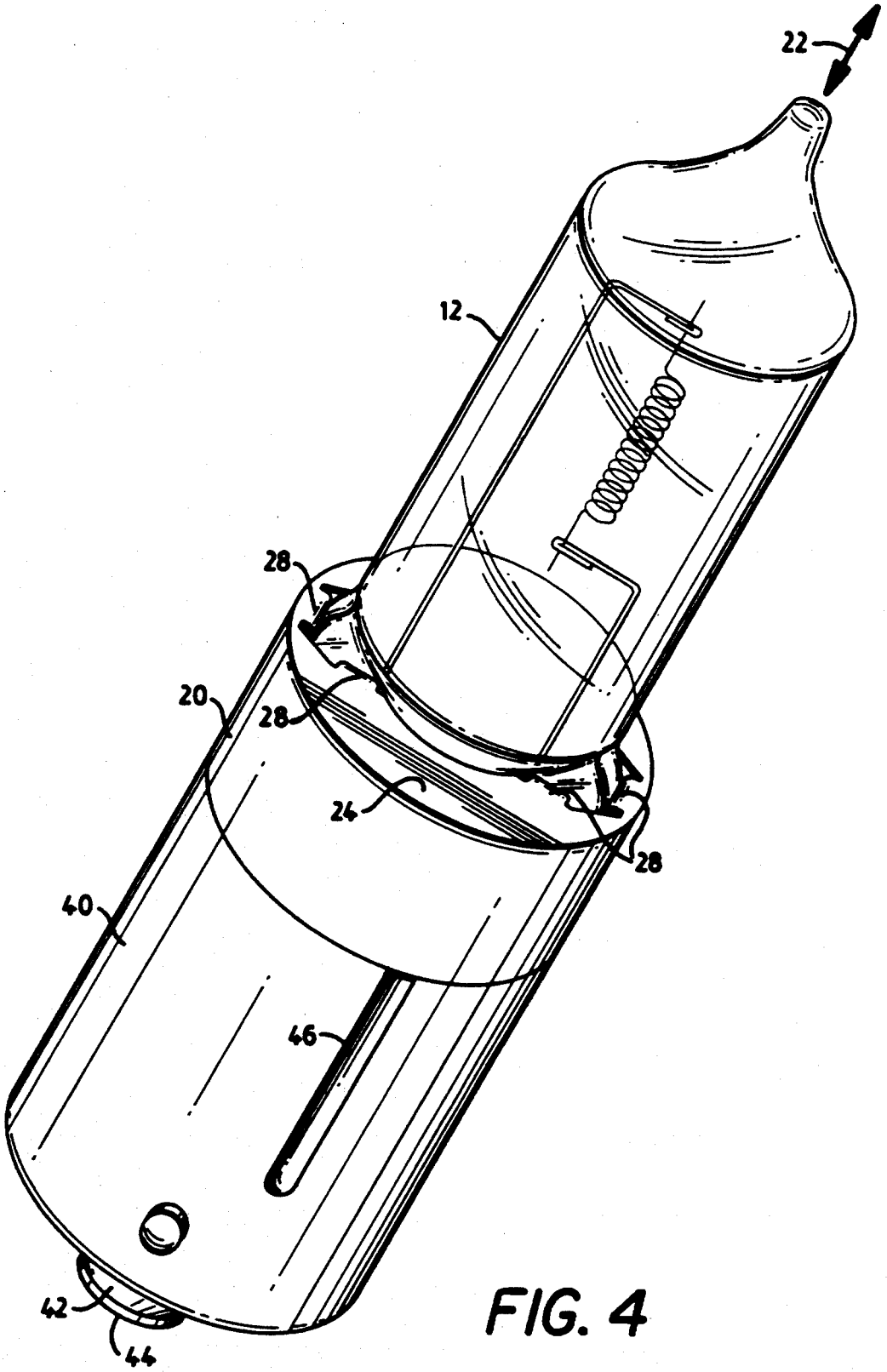
FIG. 4 shows a perspective view of the lamp.

FIG. 1 shows a lamp capsule 12, a coupler 20, and a base 40 vertically aligned prior to assembly. FIG. 2 shows an upward view through the coupler. FIG. 3 shows a cross sectional view of an assembled lamp. FIG. 4. shows a perspective view of the lamp. The lamp capsule 12 may be made out of borosilicate glass, or other hard glass to have the general form of a press sealed tube. The lamp capsule 12 includes a light source, such as a filament, in a closed vitreous volume, sealed by a press seal 14. The preferred press seal 14 is flat with no indentations or protuberances. The flat seal is easy to make, and is more reliable than sculptured seals. The flat press seal 14 also allows the lamp capsule 12 to pivot with respect to the coupler 20. Extending through the flat press seal 14 are a first lead 16, and a second lead 18. The first lead 16 is shaped and positioned to mechanically and electrically couple with the coupler 20. The preferred first lead 16 is a short straight section of stiff metal rod. The second lead 18 is shaped and positioned to mechanically and electrically couple with the base 40. The preferred second lead 18 is a stiff metal rod with two bends to locate the end of the second lead 18 that is away from the lamp capsule 12 to be coaxially centered in an eyelet 44 contact formed in the bottom of the base 40. By way of example, the lamp capsule 12 is shown as a single ended, tubular, press sealed filamentary lamp, although the lamp capsule 12 could have two or more filaments, three or more leads, be an arc lamp, have bulbous shape, or be sealed at two ends. All the suggested variations are adaptable to the present design.

FIG. 1 also shows a coupler 20 as the middle element. The coupler 20 may be made out of any electrically conductive material, to have the general form of an inverted cup. The lamp capsule 12 is formed to be pivotally supported by the coupler 20. The coupler 20 has an axis 22, a first wall 24, an internal projection 30, and a second wall 32. The preferred coupler 20 has the general form of an inverted cup with a hole formed in what would have been the bottom of the cup. The axis 22 then extends parallel with the length of the lamp capsule 12, and through the center of the coupler 20. The first wall 24 defines an opening 26 that is sized and shape to receive, and fit with the flat press seal 14. The preferred first wall 24 includes prongs 28 or tabs that extend into the defined opening 26 to meet and flexibly press against the flat press seal 14. The lamp capsule 12 may then be inserted into the coupler 20 opening 26 defined in the first wall 24 to be generally positioned with respect to the coupler 20. The prongs 28 allow the lamp capsule 12 to pivot in the opening 26 with regard to the coupler 20 in the plane and transverse to the plane of the press seal 14.

Positioned along coupler 20 is a internal projection 30. The internal projection 30 is positioned to be an electrical and mechanical coupling point for the first lead 16. The preferred internal projection 30 is formed by forming a chordal, transaxial slice 34 in a side of the coupler 20. The wall portion away from the first wall 24, and towards the open tubular end of the cup forms a strip section of the tubular wall 32 that may be indented to form an inward projecting loop, preferably with a flat or board arched middle region that is easy to solder to, and not a sharp angled crease that would be difficult to solder to. Other inward internal projections may be formed by slicing, or cutting the coupler 20 wall, and bending a section of the adjacent wall inward. The inward internal projection 30 should approach a portion of the length of the first lead 16 closely enough so that a bead of solder or other convenient electrical and mechanical coupling means may bridge any gap between the first lead 16 and the internal projection 30. Since the lamp capsule 12 is to be pivoted in the coupler 20, the first lead 16 is expected to move closer or farther from the internal projection 30. Since only relatively small pivotations are necessary to finally position most lamp capsules 12, the internal projection 30 may be located fairly close to the range of the first lead 16's movement.

The second wall 32 serves to position and mate the coupler 20 with the base 40. The preferred second wall 32 is a cylindrical wall with a first diameter leading by a step to a section of smaller diameter thereby forming a lip 36. The coupler 20 may also include one or more alignment or latching features. In the preferred embodiment, the coupler 20 includes two axially aligned indentations 38, or grooves. The preferred indentations 38 are positioned at about 120° around the coupler 20 axis 22 from one another.

FIG. 1 also shows a base 40 as the lowest of the three elements. The base 40 may be made out of conductive metal, such as nickel plated steel to have the general form of a cup. A glass gob 42 and metal eyelet 44 may be positioned in the lower end to form the familiar center contact. The preferred base 40 is for the most part designed to serve as a typical bayonet base. Formed along the interior wall of the preferred base 40 are one or more axially extending ribs 46, located about 120° around the axis from each other.

The lamp 10 is assembled by inserting the lamp capsule 12 in the coupler 20 so the flat press seal 14 is positioned in the defined hole 26 with the first lead 16 located near the internal projection 30 of the coupler 20. The spring tabs or prongs 28 act to hold the flat press seal 14 by friction, but still allow the lamp capsule 12 to be slid axially, or pivoted about the axis 22 as may be desired. The assembly is then inverted, and the coupler 20 held in a fixed position. The lamp capsule 12 is then slid, or pivoted as may be needed to properly locate the filament, or other light source. During the focusing adjustment, the lamp capsule 12 movement shifts the first lead 16, but the first lead 16 remains within a short distance of the internal projection 30. This is particularly true where the internal projection 30 has substantial axial extension, as in the indented strip described. Once the proper lamp capsule 12 position is located, the first lead 16 is soldered by a solder bead 48 to the nearby internal projection 30. The focus and soldering operations can be performed by machines in a few seconds. The soldering rigidly bridges the gap between the first lead 16 and the internal projection 30 to mechanically preserve the focus position. The solder connection also electrically couples the lamp capsule 12 to the coupler 20. If the internal projection 30 is formed as an indented loop as is preferred, the loop may be formed as a shallow loop, so the first lead 16 is soldered to the side of the loop facing inwards. Alternatively, if the loop is made deeper, or if the first lead 16 is positioned farther from the lamp axis, the first lead 16 may be captured between the inner side of the coupler 20 and the outer side of the loop, in which case the first lead may be soldered to the coupler 20 from the end of the coupler 20 or through the hole formed by the loop indentation.

The coupler 20 and base 40 are then aligned, so the coupler 20 indentations 38, are nearly collinear with the base 40 ribs 46. The lamp capsule 12 and coupler 20 assembly is then axially slipped into the base 40, so the lip 36 of the coupler 20 butts against the top rim of the base 40. Meanwhile the second lead 18 is funnelled into the eyelet 44 hole of the base 40. By making the angular separation between the coupler 20 indentations 38 and the base 40 ribs 46 a few degrees different, for example 120° and 122°, the coupler 20 and base 40 form a tight interference fit that thrusts a third section of the coupler 20 second wall 32, the side away from the indentations 38, against the base 40 wall. The coupler 20 and base 40 are then rotationally locked by the rib and groove coupling, and tightly fit together by the slight angular offset. The tight fit makes a sufficient electrical coupling between the coupler 20 and the base 40. Alteratively, the coupler 20 and base 40 may be soldered or welded along the lip 36 to the top of the base 40. The second lead 18 is then soldered to the eyelet 44, and trimmed if necessary, thereby completing the lamp assembly.

In a working example some of the dimensions were approximately as follows: The lamp capsule was made of borosilicate glass and had a tip to lead end length of 4.0 centimeters, and a tubular diameter of 1.2 centimeters. A filament was enclosed in the volume defined by the clear vitreous walls. The first lead was made of a stiff nickel coated rod 1.0 millimeters in diameter, and had a length of about 0.5 centimeters. The second lead was similar in material and in diameter, and had a length of 1.5 centimeters with two bends to position the lower end centrally and coaxially with respect to the lamp capsule axis. The capsule had a flat press seal. The coupler was made of nickel plated steel and had the form of a stepped tube, with wider end of the tube partially closed by a wall defining an entrance hole for the press seal. The narrow end of the tube had a diameter of 1.4 centimeters, and a length of 0.7 centimeters. The wider end had a diameter of 1.6 centimeters and a length of 0.6 centimeters. The narrower end was transaxially sliced midway to the tube end, through an arc of about 90° thereby defining a panel or strip between the slice and the narrow end of the tube. The panel was indented to form a inward pointed loop extending about 0.3 centimeters from the tube perimeter. Two axially extend indentations were formed in the narrower end of the coupler, having a depth of 0.51 millimeters, and an axial length of 8.9 millimeters. The indentations were positioned approximately equal angularly from each other and the indented loop.

The base was made of conductive metal, such as nickel plated steel, and had an overall length of 2.0 centimeters, and a diameter of 1.5 centimeters. Two ribs were formed on the inside of the base, having a height of 0.55 millimeters, and an axial length of 9.0 millimeters. The ribs were positioned approximately 120° from each other. In the bottom of the base was the familiar glass gob holding a metal eyelet know to those making center contact lamps.

With the above working example, the lamp capsule was readily slipped into the coupler with the an end of the first lead positioned adjacent the broad peak of the indented loop. The lamp capsule could be slid in and out and axially pivoted without moving the first lead end more than a millimeter or so from some point along the indented loop. The base could be slipped over the narrow end of the coupler, when the indentations, and ribs were aligned. The exterior end of the second lead then extended into and just to the exterior limit of the eyelet formed in the bottom of the base. Soldering the two leads in place securely fixed the lamp capsule in place. No cement needed to fill the base cavities, or to hold the lamp capsule. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A focusable lamp comprising:

a) a lamp capsule having an axis, a press seal with a first lead and a second lead extending from the press seal, b) a base having a first wall extending transverse to the axis with a defined opening to receive the press seal, and mechanical contacts to position the press seal in the defined opening, the mechanical contacts allowing focusing motion of the lamp capsule with respect to the base; the base having a second wall defining an internal region with an internally extending projection located sufficiently near the first lead to be to electrically and mechanically coupled to the first lead by a rigid, conductive bridge, the base further having a first electrical contact point electrically connected to the extending projection, and a second electrical contact point insulated from the first contact point, c) a rigid conductive bridge coupling the extending projection to the first lead to thereby hold the lamp capsule in a desired position, and electrically connect the first lead through the extending projection to the first electrical contact, and d) a second electrical coupling between the second lead and the second electrical contact point.

2. A focusable lamp comprising:

a) a lamp capsule having an axis, and a press seal with a first lead and a second lead extending from the press seal, b) a conductive coupler having a first wall extending transverse to the axis with a defined opening to receive the press seal, and mechanical contacts to position the press seal in the defined opening, the mechanical contacts allowing focusing motion of the lamp capsule with respect to the coupler, and having a second wall defining an internal region with an internally extending projection to be electrically and mechanically coupled to the first lead, c) a rigid conductive bridge coupling the extending projection to the first lead to thereby hold the lamp capsule in a desired position, d) a base having a first electrical contact point, and a second electrical contact point insulated from the first electrical contact point, wherein the base mechanically supports the coupler and is electrically coupled through the coupler to the first lead, and e) a second electrical coupling between the second lead and the second electrical contact point.

3. The apparatus in claim 2, wherein the lamp capsule includes a flat press seal.

4. The apparatus in claim 2, wherein the first lead is a rigid rod.

5. The apparatus in claim 2, wherein the second lead is a rigid rod formed to align an end of the rod with the base axis.

6. The apparatus in claim 2, wherein the coupler includes projections from the first wall to contact the press seal and help position the lamp capsule.

7. The apparatus in claim 2, wherein the internal projection is an indented band of the coupler.

8. The apparatus in claim 2, wherein the second wall includes a substantially tubular section with a formed lip, the tubular section to fit adjacent the base with a section of the base abutting the lip.

9. The apparatus in claim 2, wherein the coupler latch, and base latch comprise respectively formed sections to co-act with each other to thereby lock the coupler and base with respect to axial rotation.

10. The apparatus in claim 2, wherein the base includes a center contact and bayonet base posts.

11. The apparatus in claim 2, wherein the base wall is substantially cylindrical in form.

12. The apparatus in claim 7, wherein the internal projection includes a generally flat region adjacent the first lead for easy solder coupling between the first lead and the flat region.

13. The apparatus in claim 10, wherein the coupler latch and base latch comprise an axially aligned and meshable groove and rib.

* * * * *